US005495702A

United States Patent [19]

Ko

[11] Patent Number: 5,495,702

[45] Date of Patent: Mar. 5, 1996

[54] MEDICAL POWDER FILLING MACHINE

[76] Inventor: Hsienli Ko, P.O. Box 1-394, Chungho, Taipei Hsien, Taiwan

[21] Appl. No.: 415,542

[22] Filed: Apr. 3, 1995

[51] Int. Cl.[6] ..... B65B 43/26

[52] U.S. Cl. ..... 53/381.4; 53/281; 53/900

[58] Field of Search ..... 53/900, 381.4, 53/281

[56] References Cited

U.S. PATENT DOCUMENTS

| | | | |
|---|---|---|---|
| 4,163,354 | 8/1979 | Austin | 53/381.4 |
| 5,018,335 | 5/1991 | Yamamoto et al. | 53/281 |
| 5,081,822 | 1/1992 | Boyd et al. | 53/900 |

FOREIGN PATENT DOCUMENTS

| | | | |
|---|---|---|---|
| 0762886 | 9/1980 | U.S.S.R. | 53/900 |
| 2177074 | 1/1987 | United Kingdom | 53/900 |

*Primary Examiner*—John Sipos
*Assistant Examiner*—Ed Tolan

[57] ABSTRACT

This invention relates to a medical powder filling machine, especially a medical powder filling machine which can control the filling amount of powder by means of a non-step speed mechanism, the powder hopper mouth of the medical powder filling machine being controlled by a limit switch, the limit switch would start a motor to make the powder in the powder hopper to be filled into medical capsules when the powder hopper covering the whole medical capsule dish so as to get the same amount of medical powder in each medical capsule, furthermore the medical powder filling machine having an automatic powder filler which can fill the powder into a mold cavity of the medical capsule dish accurately by means of an intermittent movement of the medical capsule dish, in addition, the rotation speed of the powder filler and the stirrer for powder hopper being controlled by a control box, and the medicine dish motor being controlled by a non-step speed motor so as to avoid complex gear assembly.

4 Claims, 5 Drawing Sheets

MEDICAL POWDER FILLING MACHINE

BACKGROUND OF THE INVENTION

This invention relates to a medical powder filling machine, especially a medical powder filling machine which can control the filling amount of medical powder by means of a non-step speed mechanism, the filling work of the medical powder filling machine being controlled by a limit switch, only the powder hopper mouth covering the whole medical capsule dish, then the medical powder filling machine can do the powder filling work so as to fill the same amount of powder in each medical capsule, furthermore the rotation speed of the powder filler and the stirrer for powder hopper being controlled by a control box, and the medicine dish motor being controlled by a non-step speed motor so as to avoid complex gear assembly.

The conventional medical powder filling machine for medical capsule is shown as FIG. 1, the motor (100) drive a wheel (102) to transmit a rotating shaft (103), the rotating shaft (103) being fitted with some gears and a clutch (104), when the rotating shaft (103) rotating, the clutch (104) can drive two bevel gears (105) (105'), close behind, the two bevel gears (105) (105') transmit respectively a stirrer shaft (108) and a filling rod (107). The rotation speed of the medicine dish (108) and the rocking arm (109) which control the powder filler is controlled respectively by a gear control lever (110) (110'), the gear shifting levers (110) (110') control an adjusting arm (111) to adjust the rotation speed of the gear set (112). The rotation speed of the conventional medical powder filling machine is controlled by various gear match, but the number of gear teeth and the arrangement of gear is limited by the actual space, so the operator can't get every desired rotation speed, by means of gear match. It is very difficult for complex gear match to maintain or repair, furthermore the medical powder filling machine having not any device which can control the filling position of filler, which make the powder can't be filled into the medical capsule with the same amount.

SUMMARY OF THE INVENTION

It is therefore the main object of this invention to provide a medical powder filling machine, especially a medical powder filling machine which can control the filling amount of powder by means of a non-step speed mechanism, the filling work of the medical powder filling machine being controlled by a limit switch, the limit switch would start a motor to make the powder in the powder hopper to be filled into medical capsules when the powder hopper covering the whole medical capsule dish, after the filling work finished, the limit switch would stop the motor so as to the same amount of medical powder in each medical capsule.

It is the another object of this invention to provide an automatic powder filler which can be drived by a connecting link, the connecting link being hinged on a cam, on the cam having a screw groove in which having a ratchet pawl, the ratchet pawl can be swung when the cam rotating so as to make a medical capsule dish do an intermittent movement, therefore the medical capsule can be delivered into a mold cavity of the medical capsule dish accurately.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENT

Figure 1:
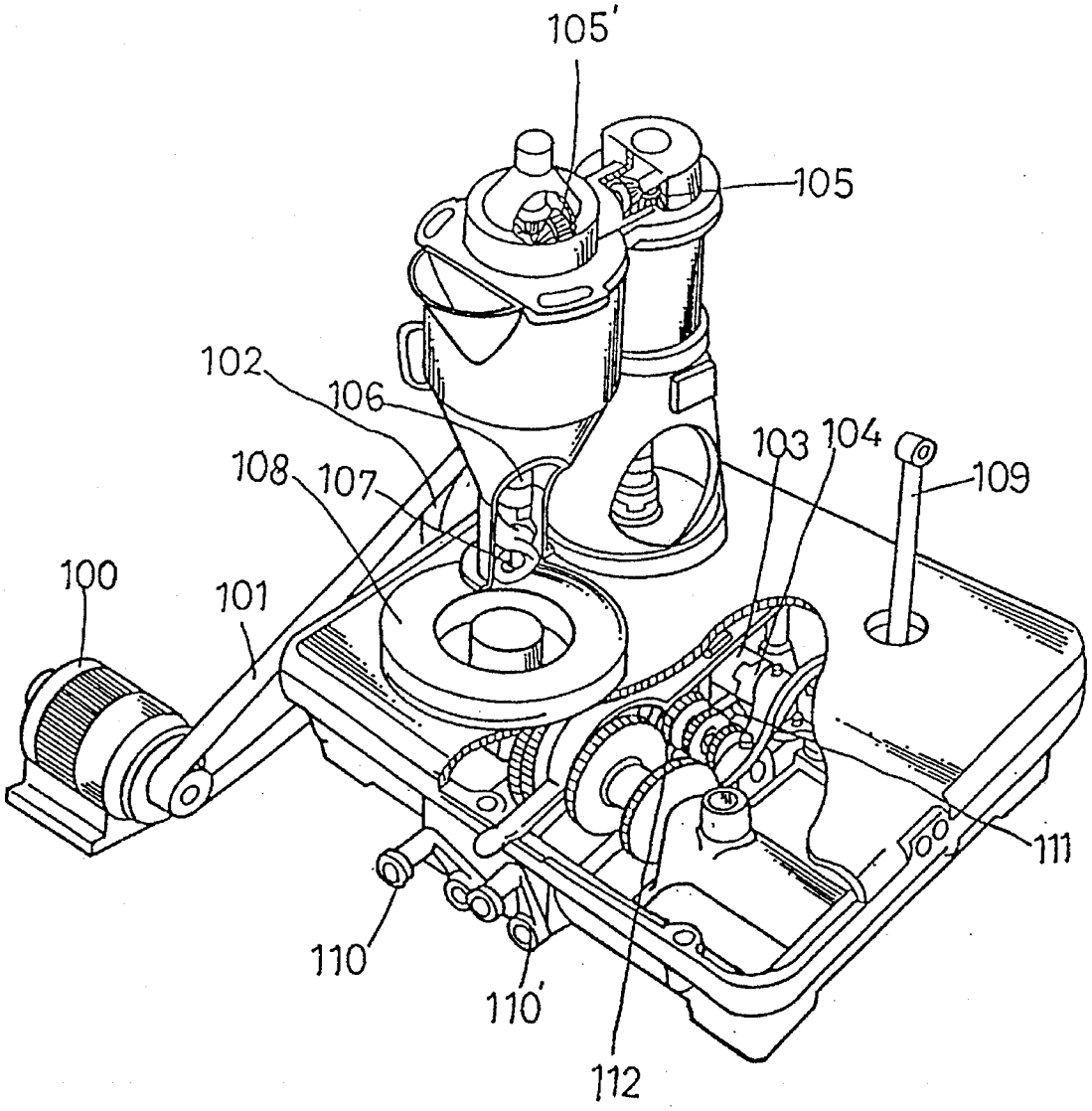
FIG. 1 is a perspective view of the conventional medical powder filling machine.
Figure 2:
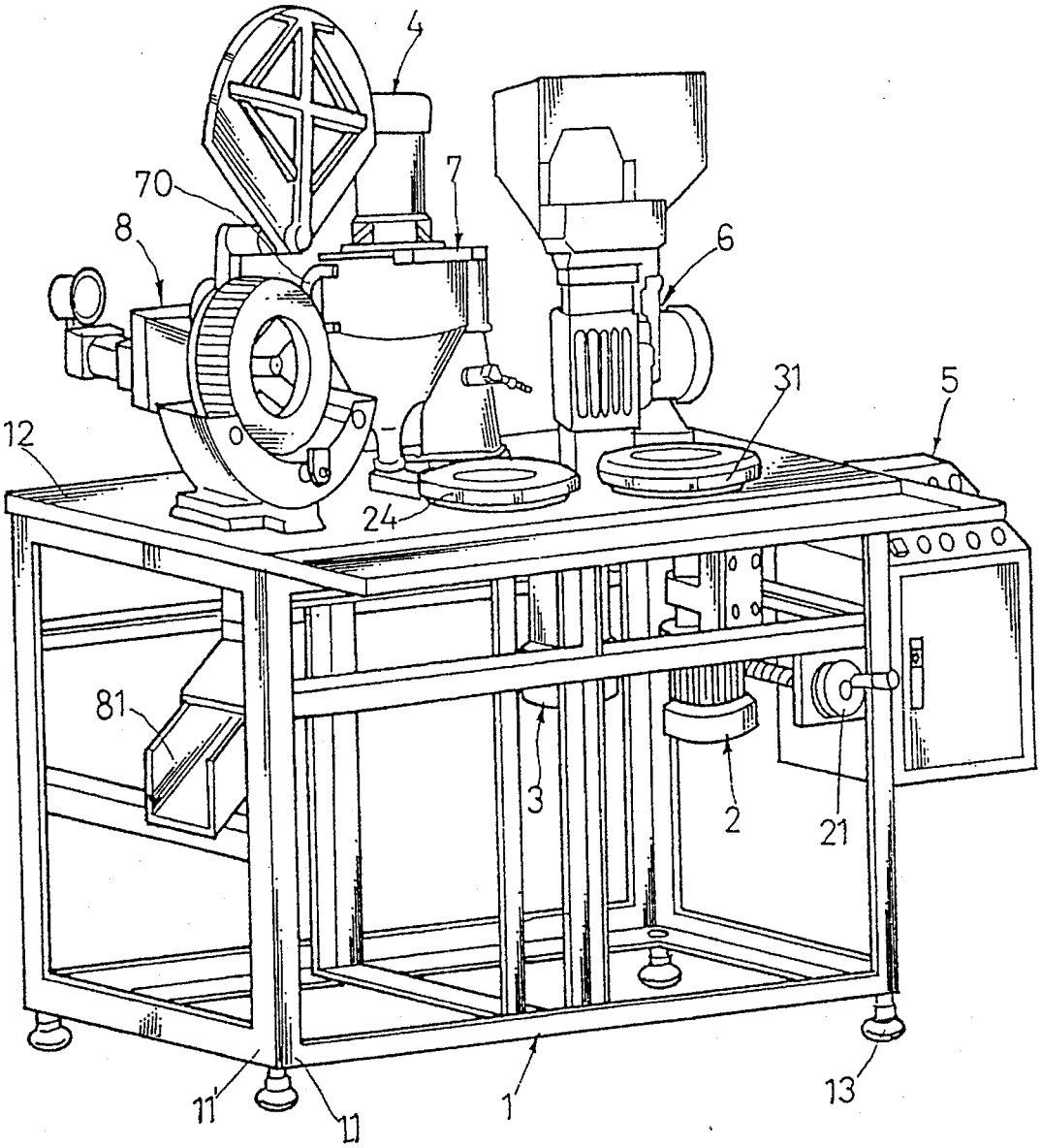
FIG. 2 is a perspective view showing a medical powder filling machine of the present invention.

Referring to FIG. 1 and FIG. 2, the present invention, a medical powder filling machine, is composed of a machine frame (1), a medicine dish motor (2), a medical capsule dish motor (3), a stirring motor (4), a control box (5), an automatic medical capsule slotter (6) and a powder hopper (7), wherein the machine frame (1) being composed of a plurality of angle steels (11) (11'), the top of the machine frame (1) having a steel plate (12), the bottom four corners of the machine frame (1) having respectively a supporting leg (13). The medicine dish motor (2) is a non-step speed motor whose speed can be controlled by a swivel wheel (21), the shaft of the medicine dish motor (2) being fitted with a gear (22) which can be engaged with a spur gear (231) installed on the rotating shaft (23), the rotating shaft (23) being covered with a flange (232) and can be fixed under the steel plate (12), furthemore the medicine dish (24) being installed on the top of the rotating shaft (23), the medical capsule dish motor (3) drive a side shaft (32) by means of gears (321), the side shaft (32) being fitted with a cam (33), on the circumference of the cam (33) having a screw groove (331) in which having a ratchet pawl (34), the ratchet pawl (34) can be swung when the cam (33) rotating so as to drive the ratchet (312) to do an intermittent movement, the ratchet (312) being installed on a roating shaft (311), furthermore the medical capsule dish (31) being installed on the rotating shaft (311) and rotated with it, therefore the medical capsule dish (31) can do an intermittent rotation when the cam (33) rotating, furthermore, the side of the cam (33) being hinged with a connecting link (35) which is connected to an automatic medical capsule slotter (6), thus the automatic medical capsule slotter (6) can insert the medical capsule into the mold cavity of the medical capsule dish (31) accurately by means of the intermittent rotation of the medical capsule dish (31). (The operation of the automatic medical capsule slotter is the same with that of the conventional medical capsule slotter. There is no need to describe here.)

Figure 3:
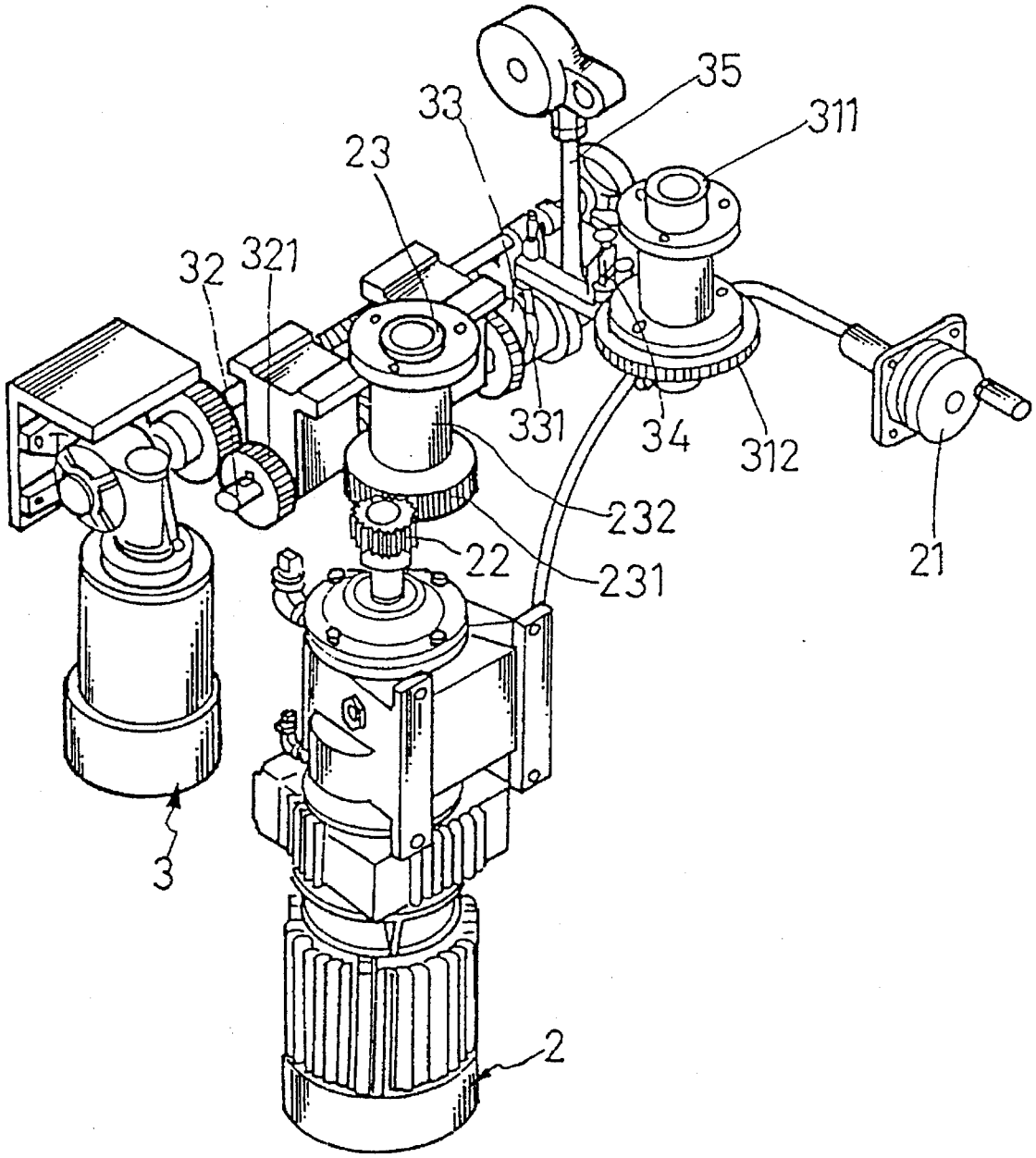
FIG. 3 is a perspective view showing the transmission mechanism for the medicine dish and the medical capsule dish of the invention.
Figures 4, 4A:
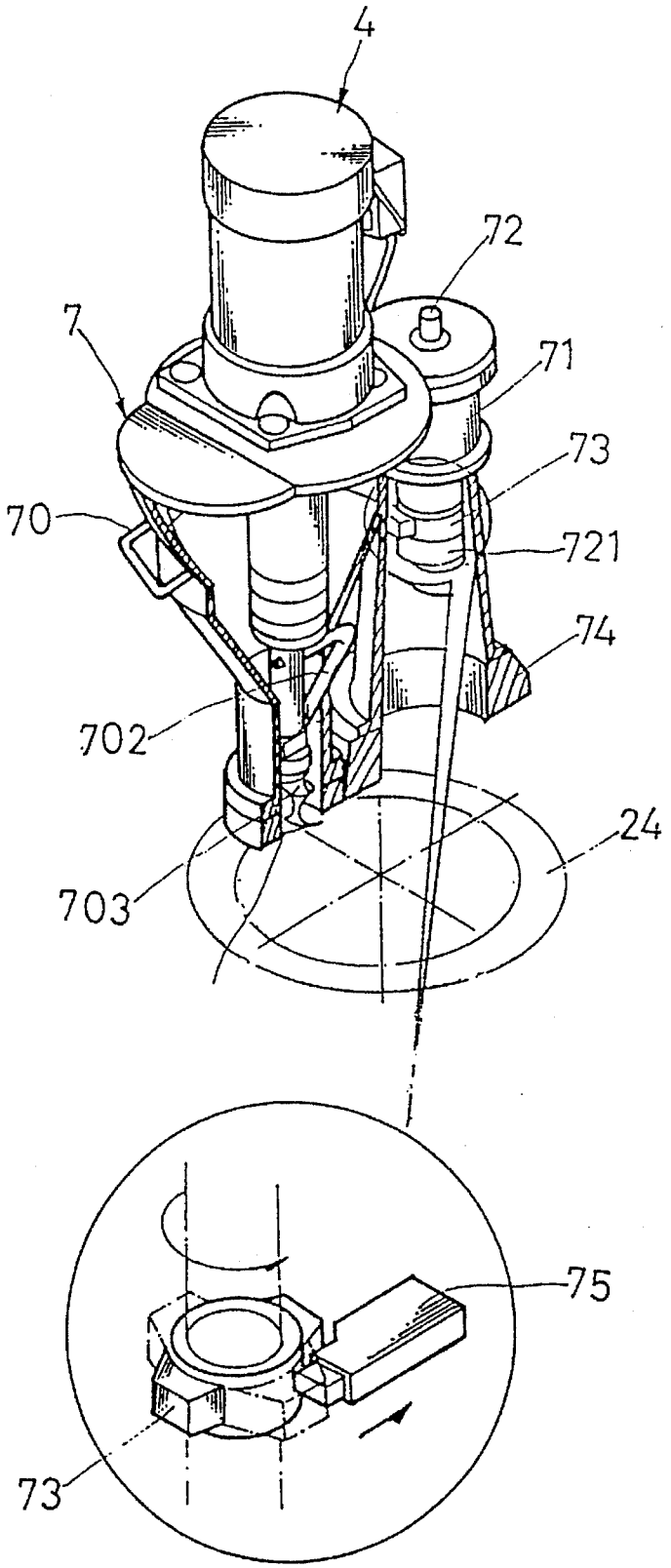
FIG. 4 is partial sectional view showing the powder filling hopper of the invention.
FIG. 4(A) is perspective view showing the details of "A" in FIG. 4; and, FIG. 5 is a back perspective view showing the interior of the invention.
Figure 5:
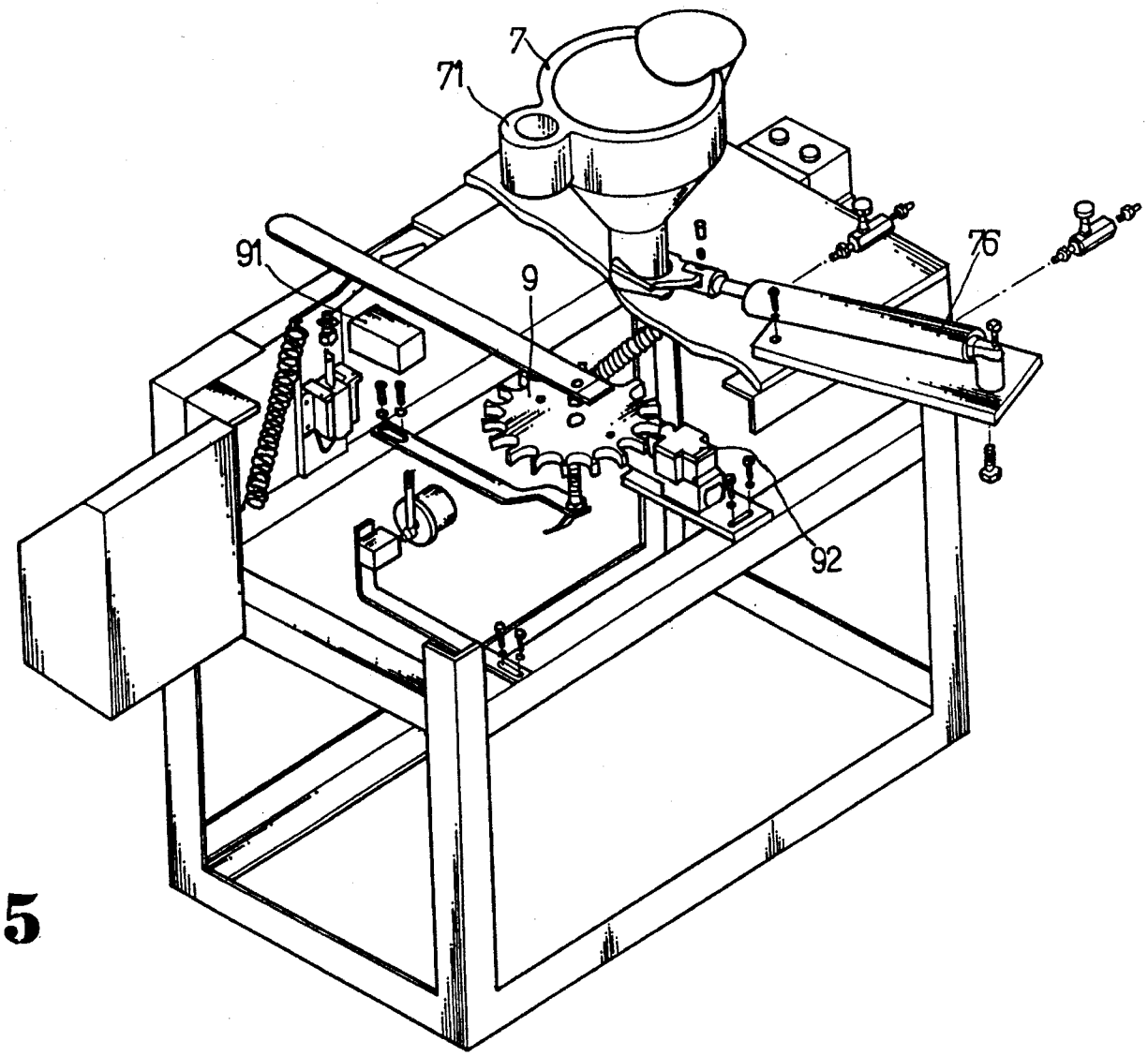

Referring to FIG. 3 to FIG. 5, the medicine dish motor (2) is controlled by a non-step speed swivel wheel (21) therefore the operator can adjust the filling amount and filling time of medical powder, the side of the powder hopper (7) being installed with a hollow cylinder (71), the center of the hollow cylinder (71) having a central shaft (72), the bottom of the central shaft (72) being fitted with a control block (73) by means of a nut (721). The bottom of the powder hopper being installed inside a base (74) and can be rotated around it, the interior of the base (74) having a limit switch (75). The operator can grasp a handle (70) to rotate the powder hopper (7) and the hollow cylinder (71), once the powder hopper mouth (701) covering the whole medical capsule dish (31), the control block (73) can be drived to rotate and push the limit switch (75) to start the stirring motor (4) which is installed on the powder hopper (7), the stirring motor (4) drive a stirring rod (702) to stir the medical powder in the powder hopper (7), furtheremore, the bottom of the stirring rod (702) being connected with a filling screw rod (703) which can push the medical powder into the medical capsule equally, therefore the medical capsules placed on the inner side and the outer side of the medicine dish (24) can be filled with the same amount of medicine powder simultaneously.

Referring to FIG. 5, the bottom of the medical capsule dish (31) have a graduated circle senser (9) on which having 360 divisions, the graduated circle senser (9) would induct a controller (91) when the graduated circle senser (9) rotates one circle (i.e. inserting 360 medical capsules into the medical capsule dish), then the controller (91) transmitting a singal to an electro magnetic valve (92) to stop the medical capsule dish (31) from rotation. The bottom of the medical powder dish (24) also have a graduated circle senser (not shown in the FIG. 5), the graduated circle senser would induct a controller when it rotates one circle, then the controller transmitting a signal to an electro magnetic valve to stop the medical powder dish (24) from rotation.

Referring to FIG. 2, the medical capsule dish motor (3) and the stirring motor (4) are controlled by the control box (5) which is installed on the machine frame (1), the rotation of the medical powder dish (24) being controlled by the medical powder dish motor. The medical capsule slotter (6) insert the medical capsule in order into the cavity of the medical capsule dish (31), then the upper part and the lower part of the medical capsule dish (31) can be aparted, therefore the medical capsules can be divided into two parts, close behind, putting the medical capsule dish (31) on the medical powder dish (24) so as to fill powder into the medical capsules, the last, putting the medical capsules dish (31) on a fitting device (8) so as to combine the medical capsules together, the combined medical capsules can be delivered out from an exit (81). the powder filling operation and the combination of the medical capsule is understood by those skilled in the art. There is no need to describe here.

It is understood by those skilled in the art that the forgoing description is a preferred embodiment of the disclosed device and that various changes and modifications may be made in the invention without departing from the spirit and scope thereof.

What is claimed is:

1. A medical powder filling machine comprising a machine frame, a medicine dish motor, a medical capsule dish motor, a stirring motor, a control box, a powder hopper with a powder filling assembly having a mouth and an automatic medical capsule slotter, the medical powder filling machine characterized in that: said medical capsule dish motor drives a side shaft by means of gears, said side shaft being fitted with a cam the circumference of said cam having a screw groove containing a ratchet pawl, as the cam rotates said ratchet pawl swings to drive a ratchet in an intermittent movement;

the ratchet being attached to the bottom of a rotating shaft, a medical capsule dish with a mold cavity therein rests on the top of said rotating shaft and rotates with it, said medical capsule dish rotates intermittently when the cam rotates;

a connecting link hinged to the side of the cam and connected to said automatic capsule slotter;

the automatic capsule slotter inserts the medical capsules into the mold cavity of said medical capsule dish accurately by means of the intermittent rotation of the medical capsule dish the medical capsule dish containing the capsules is placed in the medicine dish and filled through the powder hopper.

2. A medical powder filling machine as claimed in claim 1, wherein said stirring motor is connected to the powder hopper, the side of the powder hopper contains a hollow cylinder, the bottom of said hollow cylinder is situated inside a base and rotating means rotate the hollow cylinder around the base.

3. A medical powder filling machine as claimed in claim 2, wherein a central shaft lies in the center of said hollow cylinder, the bottom of said central shaft connects with a control block by means of a nut, said central shaft rotates with the hollow cylinder.

4. A medical powder filling machine as claimed in claim 2, the interior of the base has a limit switch, when the mouth of the powder hopper covers the medical capsule dish said control block rotates until it engages the limit switch which starts the stirring motor and the filling process.

* * * * *